US005785069A

United States Patent [19]

Glatz

[11] Patent Number: 5,785,069

[45] Date of Patent: Jul. 28, 1998

[54] STANDING UMBRELLA

[75] Inventor: Gustav Adolf Glatz, Frauenfeld, Switzerland

[73] Assignee: Glatz AG, Frauenfeld, Switzerland

[21] Appl. No.: 693,321

[22] PCT Filed: Jan. 13, 1995

[86] PCT No.: PCT/CH95/00009

§ 371 Date: Aug. 19, 1996

§ 102(e) Date: Aug. 19, 1996

[87] PCT Pub. No.: WO95/23532

PCT Pub. Date: Sep. 8, 1995

[30] Foreign Application Priority Data

Mar. 3, 1994 [CH] Switzerland ..... 631/94

[51] Int. Cl.[6] ..... A45B 11/00

[52] U.S. Cl. ..... 135/20.1; 135/20.3; 135/21

[58] Field of Search ..... 135/17, 18, 19, 135/19.5, 20.1, 20.3, 25.4, 21

[56] References Cited

U.S. PATENT DOCUMENTS

| | | | |
|---|---|---|---|
| 373,809 | 11/1887 | Blunt | 135/21 |
| 3,383,814 | 5/1968 | Rowe | 135/21 X |
| 4,424,824 | 1/1984 | Becher . | |
| 4,606,366 | 8/1986 | Collet . | |
| 5,116,258 | 5/1992 | Vennik | 135/21 X |
| 5,386,842 | 2/1995 | Becher | 135/20.3 |

FOREIGN PATENT DOCUMENTS

| | | | |
|---|---|---|---|
| 0334219 | 9/1989 | European Pat. Off. | 135/20.1 |
| 0 387 965 | 3/1990 | European Pat. Off. . | |
| 0948421 | 8/1949 | France | 135/20.1 |
| 2 581 114 | 4/1985 | France . | |
| 3339163A1 | 10/1983 | Germany . | |
| 3307718 | 9/1984 | Germany | 135/20.1 |
| G 93 06 925 | 5/1993 | Germany . | |
| 0984835 | 3/1965 | United Kingdom | 135/20.1 |

*Primary Examiner*—Lanna Mai
*Attorney, Agent, or Firm*—McCormick, Paulding & Huber

[57] ABSTRACT

A standing umbrella has a mast on which the inner end of an outwardly and inwardly movable carrier beam is guided with the outer end of the beam carrying an umbrella stick of a collapsible umbrella and with the carrier beam being held by a connecting strut linkedly arranged between the upper end of the mast the carrier beam. A drive mechanism shifts the inner end of the carrier beam along the length of the mast and the mast has two guide tracks spaced from one another and so profiled that guide elements running there along and carried by the inner end of the mast are held by the shape of the tracks against movement transversely to the direction in which the inner end of the carrier beam is shifted; and the drive mechanism for shifting the inner end of the carrier beam and a drive mechanism for opening and closing the umbrella are so combined with one another that they operate simultaneously in common.

17 Claims, 5 Drawing Sheets

STANDING UMBRELLA

FIELD OF THE INVENTION

The invention concerns a standing umbrella with a stand having a mast on which the inner end of an outwardly and inwardly movable carrier beam is guided, the beam carrying the umbrella stick of a collapsible umbrella at its outer end and being held by means of a connecting strut linkedly arranged between the carrier beam and the upper end of the mast, and a drive mechanism for shifting the inner end of the carrier beam as well as for opening and closing the umbrella.

BACKGROUND OF THE INVENTION

A standing umbrella of the above-mentioned type is, for example, known from EP-PS 0 387 965. In the standing umbrella of that patent, the inner end of an outwardly and inwardly movable carrier beam is guided in the interior of the mast through an elongated slot and is connected with a drive mechanism consisting of a circulating member driven by means of a hand crank drive. A tension member, for example a cable, which at its inner end facing the mast is rigidly connected with the mast, serves to open the umbrella. From the mast, the tension element runs to and through the hollow carrier beam to the outer end of the beam, where the tension element is bent toward an upper hollow umbrella stick. The tension member is at its outer end connected with a further lower umbrella stick to the lower end of which support struts are pivotally connected, which struts in turn are pivotally connected with roof rods, which rods are pivotally connected to a crown located in the upper area of the upper umbrella stick. Upon outward extension of the carrier beam by sliding upwardly its inner end, the tension member is automatically drawn rearwardly relative to the mast whereby the lower umbrella stick portion is moved telescopically into the upper umbrella stick portion and the umbrella is opened. The lower umbrella stick portion then arrives at a pivotal connection between the upper umbrella stick and the carrier beam in the region above the crown, and locks this pivotal connection.

In this standing umbrella, there exists the disadvantage that the mast is weakened by the elongated guide slot, so that its bending and torsional rigidities are reduced, so that on one hand there exists the danger of a breakage of the mast and on the other hand, the danger of contortion when loaded by winds. Moreover, the tension member for opening and closing the umbrella lies freely accessible on the outside of the mast so that it is exposed to the danger of damage. Also, an inclined positioning of the umbrella by adjustment of the carrier beam is not possible since for opening of the umbrella the carrier beam must always be fully extended.

SUMMARY OF THE INVENTION

The object of the invention is to further improve a standing umbrella of the above-mentioned kind.

The object of the invention is solved by having the mast of the standing umbrella include two guide tracks spaced from one another by a spacing and so profiled that the guide elements which move along said tracks are held against movement perpendicularly to the sliding direction. By the two spaced and profiled guide tracks for the guide elements on the inner end of the carrier beam, the transverse sturdiness of the carrier beam relative to the mast is improved so that the carrier beam and with it the standing umbrella are made more resistant to wind loads.

The invention also resides in the carrier beam drive mechanism for shifting the inner end of the carrier beam and the drive mechanism for opening and closing the umbrella, being so combined with one another that they are simultaneously operable in common, which results in an improved and reliable drive of the standing umbrella, and which also permits various different development possibilities.

The invention also resides in other features of the standing umbrella as clearly set forth in the claims.

The mast can consist of a solid profile, however, a preferred profile is that of a closed hollow cross section. The closed hollow cross section provides not only good bending and torsional rigidity, but also leads to a weight saving and the possibility of the drive and/or control elements being located inside of the mast, which is of advantage for the protection of construction components and/or for aesthetic reasons.

For the implementation of the guide tracks, several possibilities exist. For example, the guide tracks can be open roller or slide tracks on which the guide elements are held by means of a cuff surrounding the mast. Also, dovetail guides are possible. An especially preferred implementation is that in which the guide tracks have guide grooves lying in the guide plane and perpendicular to the guide direction with the grooves extending transversely to the guide tracks and being directed toward and/or away from another.

Also, for the hollow profile cross section of the mast, several profile shapes are possible, as for example, a round profile with flats at the guide tracks or a multi-cornered profile, in which case a preferred shape is a rectangular one on one side of which the guide tracks are arranged.

In its simplest form, the inner end of the carrier beam can directly carry a guide element. Advantageously, however, an implementation is preferred in which the guide elements are arranged on a guide carriage linkedly connected with the inner end of the carrier beam so that the stability and guiding characteristics of the carrier beam on the mast are improved.

Several possibilities exist for the implementation of the drive mechanism. An especially simple construction is one in which the carrier beam drive mechanism includes a circulating member located inside the mast and drivable by a drive powered by a hand crank or motor, which circulating member at the end of the path of the guide elements is bent over direction changing members and through through openings on the outer side of the mast in the area of the guide tracks, this construction weakening the cross section of the mast as little as possible and on the other hand giving optimal protection to the circulating member.

An especially advantageous construction of the standing umbrella is one in which the mast is arranged to incline rearwardly so that the center of gravity of the closed umbrella lies above the anchoring region of the mast in the earth. This results in the advantage that the tipping moment of the standing umbrella in the closed condition of the umbrella is as small as possible. Moreover, the lying of the closed umbrella against the mast supports the closed umbrella and thereby inhibits falling of the umbrella from the mast. The inclined position of the mast also improves the appearance of the standing umbrella in its closed condition as well as in its open condition and conceals a possible bending of the mast when the umbrella is open.

The umbrella drive mechanism can be equipped with a suitable drive, for example, a suitable hand crank or a suitable motor; however, an advantageous inventive construction is that in which the carrier beam drive mechanism and the umbrella drive mechanism for opening and closing the umbrella are so combined that they are simultaneously operable in common.

A practical implementation of the carrier beam drive mechanism is one having a circulating member drivable through a drive by means of a hand crank or motor which circulating member is connected with the inner end of the carrier beam and at the end of the shifting path of the carrier is guided over direction changing members such as direction changing rolls, and is preferably one in which the carrier beam drive mechanism has a spindle preferably provided with a self-arresting thread on which spindle is arranged a threaded nut connected with the circulating member. By means of the spindle, the necessary drive force can be optimally set according to the pitch of the thread and/or on the other hand a self checking by the thread is obtained so that brakes and the like are not required.

Various different possibilities exist as to the construction of the umbrella drive mechanism. An especially advantageous construction is one in which the umbrella drive mechanism for opening and closing the umbrella includes a tension member guided over the upper end of the mast, over the connecting strut and a joint into the carrier beam, to the outer end of the carrier beam and through the umbrella stick to a terminating member for the lower ends of the support struts, to which terminating member the tension member is connected, the support struts being linkedly connected to roof rods which in turn are linkedly connected with a crown arranged on the umbrella stick. This construction on one hand makes possible an optically non-disturbing guide for the tension member and on the other hand protects the tension member against damage. Further, the tension member can be directly coupled with the circulating member or can be indirectly coupled with the circulating member in that it, for example, is connected to a common drive member for the circulating member and for the tension member.

A preferred development of the standing umbrella is that the tension member is provided with a mechanism operable during opening of the umbrella for releasably arresting the tension member and uncoupling it from the circulating member, this making it possible to adjust the carrier beam with the umbrella in opened condition in order to change the position of the umbrella, for example, to suit changes in the position of the sun. An advantageous implementation of the mechanism for releasably arresting the tension member is one wherein the tension member is connected with the circulating member by a stop which couples only in the opening direction and which stop on its end facing away from the umbrella has an arresting member cooperable with an inwardly movable bolt associated with the mast.

Especially advantageous is a refinement wherein the tension member is guided over a compensating mechanism to compensate for tension changes in the tension member resulting from changes in the length along which the tension member passes around direction changing rolls at different angular positions of the carrier beam, this improving the opening and spreading of the umbrella. An especially simple implementation of the compensating mechanism is one in which the compensating mechanism includes a direction changing roll for the tension member arranged on the pivot axis for the connecting strut with two assisting rolls associated with the direction changing roll, the first of which assisting rolls is on the mast side and the second of which assisting rolls is on the connecting strut with the assisting rolls being so arranged that the tension member passes over the first assisting roll and from there under the direction changing roll and then over the second assisting roll which guides it to the connecting strut.

Various possibilities exist in connection with the pivotal arranging and arresting of the umbrella on the outer end of the carrier beam. An especially simple solution for this is to have the carrier beam have its pivot axis displaced downwardly from the carrier beam axis, which displaced pivot axis is pivotally connected to the umbrella above the crown, the umbrella stick being elongated upwardly to the region of the axis of the carrier beam and there carrying a direction changing roll for the tension member.

BRIEF DESCRIPTION OF THE DRAWINGS

Exemplary embodiments of the standing umbrella of the invention are described in more detail hereinafter in connection with the drawings, which show.

DETAILED DESCRIPTION OF THE PREFERRED EMBODIMENTS

Figure 1:
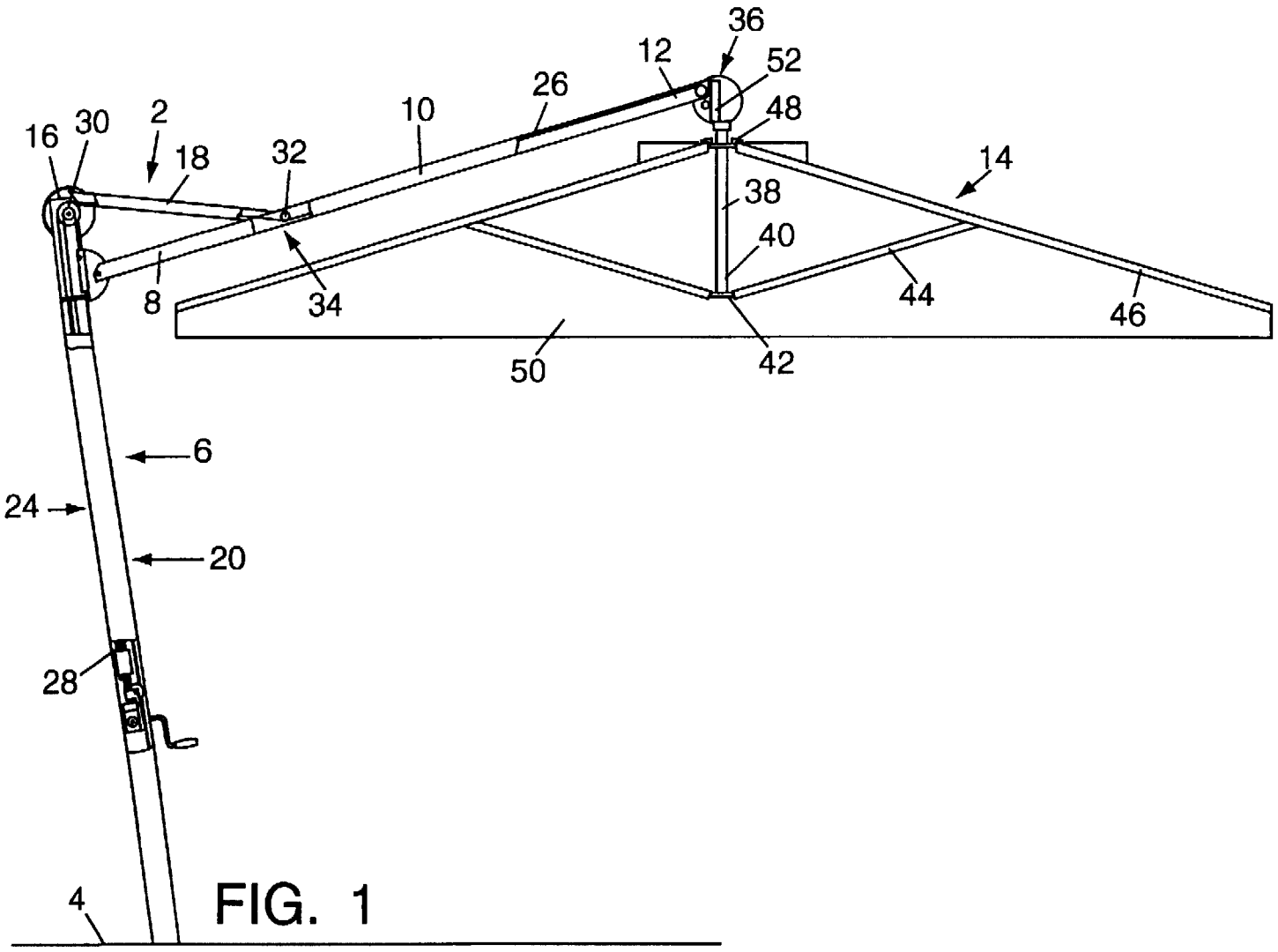
FIG. 1 - A standing umbrella embodying the invention in opened condition, in side view and with some portions shown broken away.
Figure 2:
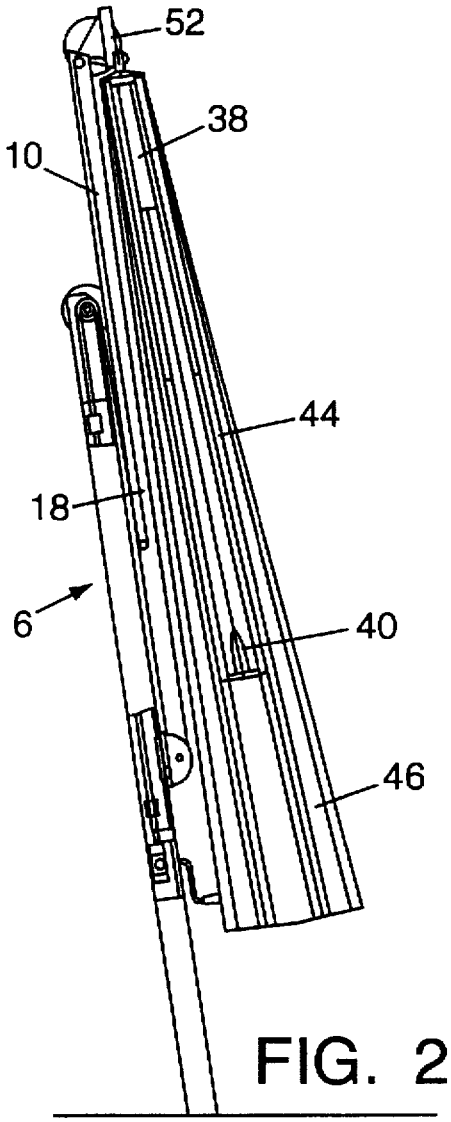
FIG. 2 - The standing umbrella of FIG. 1 in closed condition and with the roof layer removed, in side view and partially broken away.

The standing umbrella, shown in its entirety in FIGS. 1 and 2 and in detail in FIGS. 3–7, has a stand (2) including a mast (6) anchorable either directly or indirectly into the ground (4). The mast is preferably arranged so as to be inclined rearwardly about 7° so that the center of gravity of the closed standing umbrella, as seen in FIG. 2, is located over the anchoring position of the mast in the ground. The inner end (8) of a carrier beam (10) is supported against the mast (6) and the outer end (12) of the beam carries an umbrella (14). A connecting strut (18) is linkedly connected between the carrier beam (10) and the upper end (16) of the mast (6). A carrier beam drive mechanism (20) arranged in the mast (16) is connected with a guide element (22) on the inner end (8) of the carrier beam (10), to shift the inner end of the carrier beam back and forth along the length of the mast, in order to move the carrier beam between a deployed position shown on one hand in FIG. 1 and a withdrawn position shown on the other hand in FIG. 2 and to desired intermediate positions. These movements, as well as the opening and closing of the umbrella, are possible without being hindered by tables and chairs.

Figure 7:
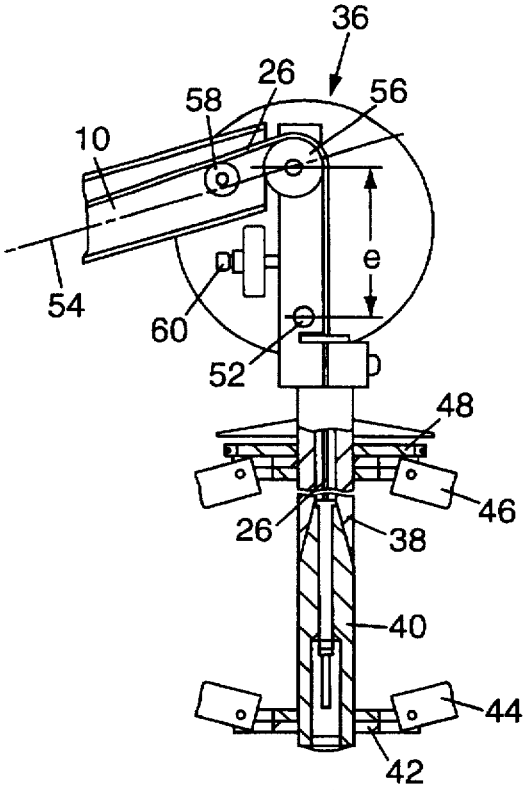
FIG. 7 - The umbrella which is arranged on the carrier beam, in fragmentary view, partially broken away and in enlarged scale.

The standing umbrella also includes an umbrella drive mechanism (24) having a tension member (26) whose inner end (28) is located inside of the mast (6). From there, the tension member (26) runs over a direction changing member (30) at the upper end of the mast: (6) into and through the connecting strut (18) (FIG. 3), from there over a direction changing member (32) at the joint (34) between the connecting strut (18) and the carrier beam (10) (FIG. 6) and lastly into and through the carrier beam (10) to the forward end of the same. A further direction changing means (36) guides the tension member (26) through the interior of a hollow umbrella stick (38) to a spine (40) located below the umbrella stick (38), as best seen in FIG. 7. The spine (40) carries a rosette (42) to which the support struts (44) are pivotally connected, the support struts being in turn pivotally connected with roof rods (46), the roof rods at their inner ends being pivotally connected to a crown (48) fastened to the upper portion of the umbrella stick (38). The roof rods (46) carry a roof layer (50) of the umbrella. The umbrella stick (38) above the crown (48) is pivotally supported for movement relative to the carrier beam (10) about an eccentrically arranged pivot axis (52), so that the umbrella stick is lengthened by approximately the eccentricity e of the pivot axis (52) from the axis (54) of the carrier beam, and the umbrella stick at its upper end carries a direction changing roll (56) over which the tension member (26) is guided. The carrier beam (10) itself likewise carries a direction changing roll (58) over which the tension member (26) runs. The two direction changing rolls (56,58) together form the above-mentioned direction changing means (36). When the tension member is loose, the umbrella takes on the collapsed condition shown in FIG. 2. Upon drawing in of the tension member (26), the spine (40) moves against the lower end of the umbrella stick (38) and becomes fixed there so that the support struts (44) spread the roof rods (46) into the opened condition of the umbrella, and at the same time the umbrella stick is pivoted about the pivot axis (52) until the upper end of the umbrella stick (38) engages the carrier beam (10) and is held there by a tension in the tension member. The position of the umbrella (14) relative to the stand (2) can be adjusted by means of an adjusting screw (60).

Figure 4:
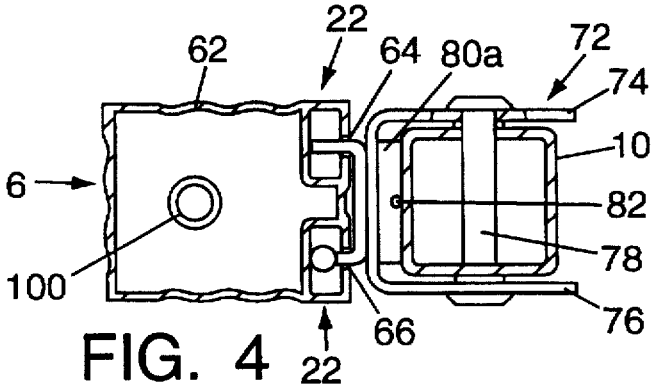
FIG. 4 - The mast of FIG. 3 in a section taken on line IV–IV of FIG. 3.
Figure 3:
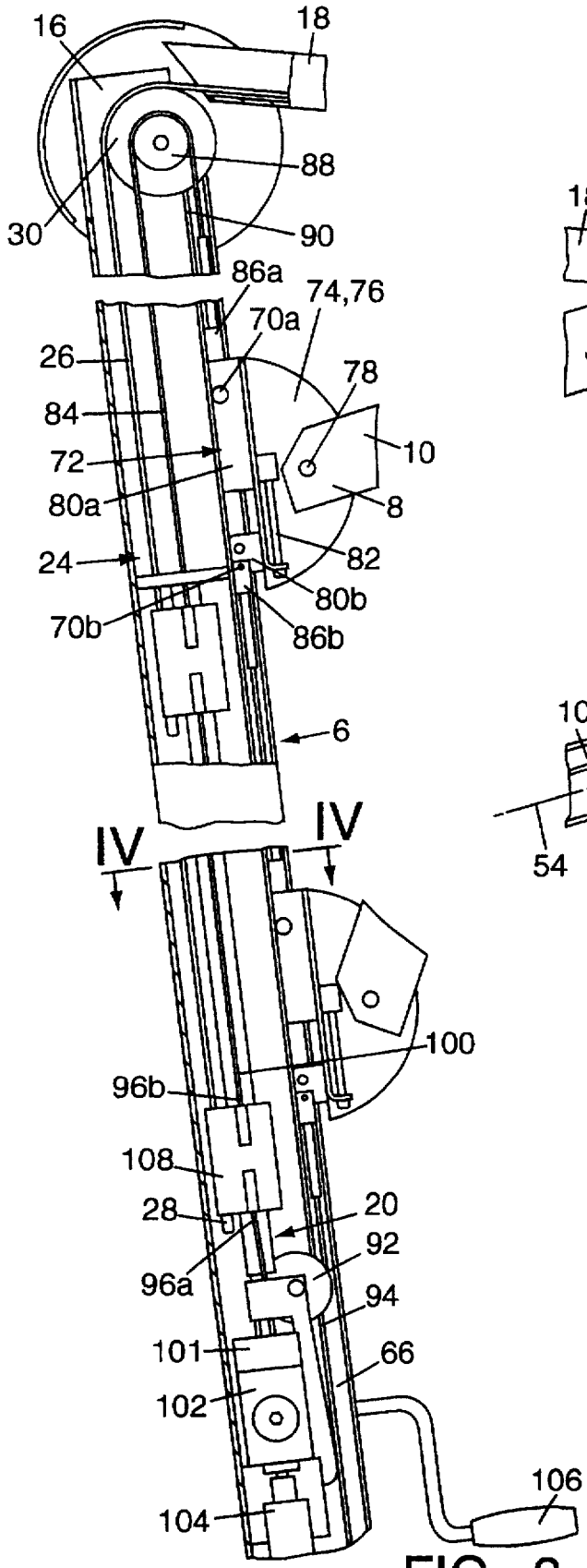
FIG. 3 - A portion of the mast of the standing umbrella in longitudinal section and in enlarged scale.
Figure 6:
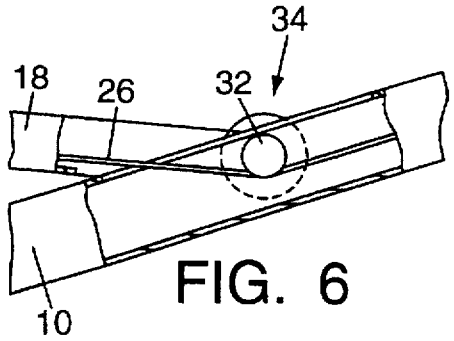
FIG. 6 - The area in which the connecting strut is connected to the carrier beam, partially broken away and in enlarged scale.
Figure 5:
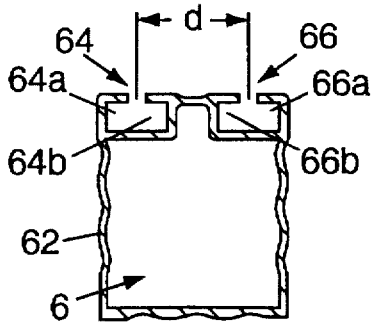
FIG. 5 - The hollow profile of the mast in detail.

FIGS. 3–5 show in detail the hollow profile of the mast (6) as well as the support and drive of the inner end (8) of the carrier beam (10) on the mast (6). The mast (6) has a closed hollow profile (62) with a rectangular cross-section. On one side of the hollow profile are two guide tracks (64,66) arranged at a spacing d from one another, in which tracks the associated guide elements (22) are received. Each guide track (64,66) contains in the guide plane and arranged perpendicular to the guide direction guide grooves (**64*a*, 64*b* and 66*a*, 66*b*, respectively) which respectively are located opposite to one another. The guide elements in this case consist of guide rollers (68*a*, 68*b* and 70*a*, 70*b*, respectively) arranged so as to lie behind one another in the guide tracks (64,66) and supported on a guide carriage (72) having two cheeks (74,76) between which the inner end of the carrier beam (10) is pivotally connected by a bolt (78). The guide carriage (72) has a first foot portion (80*a*) for receiving the guide rolls (68*a* and 70*a*) and a second foot portion (80*b*) for receiving the other guide rolls (68*b* and 70*b*), the foot portions (80*a*, 80*b*) being connected with one another by an adjusting screw (82) which serves to tighten the later to be described circulating member (84) of the carrier beam drive mechanism (20**).

The carrier beam drive mechanism (20) includes the already mentioned circulating member (84) which with its outer ends (**86*a*, 86*b*) is attached to the foot portions (80*a*, 80*b*) of the guide carriage (72). The circulating member (84), which for example in the illustrated case is a circulating cable, is guided in a guide track (66) along the length of the mast and extends over an upper direction changing roll (88) and through a through opening (90) of the mast (6). At the lower end, a change in direction takes place analogously by means of a direction changing roll (92) and a further through opening (94) in the cross section of the mast. The inner ends (86*a*, 86*b*) of the circulating member (84) are fixed to a threaded nut (98) arranged on a spindle (100). The spindle is driven by an electric motor (104) and associated drive (102) through a brake mechanism (101), such as for example a centrifugal action brake not illustrated in more detail. One such drive unit is described in more detail in WO 92/14377. The thread of the spindle (100) and/or the drive (102) can also be so formed that they are self-retarding, so that a brake mechanism is not necessary. Instead of or supplementary to the electric motor (104), the drive mechanism for the carrier beam can also be equipped with a removable hand crank (106**).

The umbrella drive mechanism (24) and the carrier beam drive mechanism (20) are combined with one another so that the actuation of the carrier beam drive mechanism also actuates the umbrella drive mechanism (24), that is, upon the moving out of the carrier beam (10) the umbrella (14) is simultaneously opened and likewise upon the moving in of the carrier beam (10) the umbrella (14) is simultaneously closed. The combination of the drives take place in such way that the inner end (28) of the tension member (26) is connected through a follower mechanism (108) with the threaded nut (98), to which the circulating member (84) of the carrier beam drive mechanism (20) is also connected.

Figure 8:
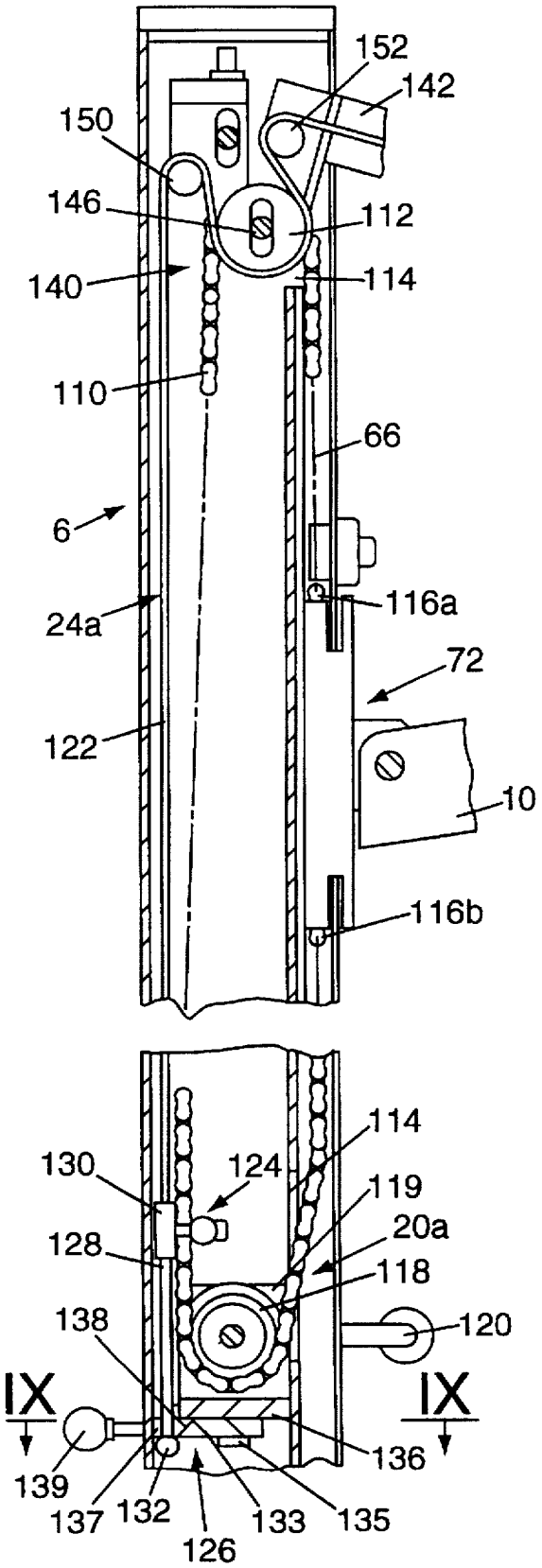
FIG. 8 - The mast of a standing umbrella comprising a further embodiment of the invention in fragmentary view and in longitudinal section.

FIG. 8 shows details of a carrier beam drive mechanism (**20*a*) and of an umbrella drive mechanism (24*a*) of a further umbrella in fragmentary, broken away view, wherein features identical with those of the previous exemplary embodiment have been given the same reference numbers. The carrier beam drive mechanism (20*a*) again includes a circulating member (110) in the form of a chain which at the upper mast portion is guided around a direction changing roll (112) and through a through opening (114) on the outer side of the mast (6), and which is connected by mean of its ends (116*a*, 116*b*) to a guide carriage (72). A lower direction changing roll (118) is formed as a sprocket wheel with built-in brake mechanism (119) and serves at the same time as a drive roll, which for example is drivable by means of a hand crank (120). The circulating member (110) is also guided on a lower direction changing roll (118) and through a through opening (114**).

A tension member (122) of the umbrella drive mechanism (**24*a*) is directly coupled with the circulating member (110) through a follower device (124). The umbrella drive mechanism (24*a*) further includes a releasable arresting mechanism (126), which permits an uncoupling of the tension member from the circulating member (110) when the umbrella is opened. In connection with this, the tension member (122) includes at its inner end a stop (128) which projects from the follower device (124) on the side thereof facing away from the umbrella. The tension member itself is guided slidably in a bore (130) of the follower mechanism (124). The stop is elongated downwardly and carries at its end facing away from the umbrella an arresting element (132) which is stoppingly engagable with a lock bolt (133) arranged on the mast for inward movement. The bolt (133) consists of a plate containing elongated holes (134) arranged in the interior of the mast (6**) through which threaded bolts (135) extend which hold the bolt and plate slidably on a carrier (136) of the mast (6). The bolt includes a fork-like part (137), which in a pushed-in free position of the bolt (133) frees the passage of the arresting element (132), and which in the pulled-out stop position shown in FIGS. 8 and 9 stops the arresting element. An inclined ramp surface (138) in the region of the fork-like part (137) of the bolt (133) serves to urge the bolt (133) rearwardly to the free position. The arresting element: (132) can therefore during the opening of the umbrella move the bolt (133) from the stopping position to the free position by means of the ramp surface (138) and thereby free its passage to its arresting position. An accessible hand grip (139) on the outer side of the mast serves for shifting the bolt (133) and thereby for locking or freeing the arresting element (132). For arresting the opened umbrella, the bolt (133) is therefore brought to its arresting position on the mast and rearwardly grips the arresting element (132) with its fork-like portion (137), so that upon operation of the circulating member (110) by means of the hand crank (120) the stop (128) moves free of the follower mechanism (124) and the follower (124) slides by means of the bore (130) over the tension member (122). Thereby the inner end of the carrier beam can be moved, without the umbrella being closed, so that the position of the umbrella can be changed, as for example to suit flat rays of sunshine.

Figure 9:
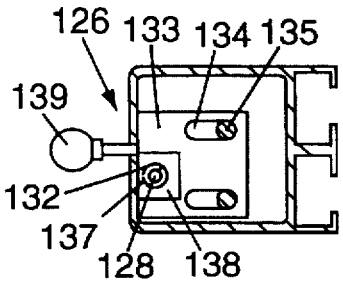
FIG. 9 - An arresting mechanism in sectional view taken on the line IX–IX of FIG. 8.

The umbrella of FIGS. 8 and 9 is further equipped with a compensation device (140) for adjusting for changes in the tension and length of the tension member (122) as a result of changes in length of the portions of it which pass over the direction changing rolls, especially the direction changing roll (32) of the joint (34), in the case of different angular positionings of the carrier beam (10). The compensation device (140) is made by a roller system arranged in the area of the joint connecting the connecting strut (142) to the upper end of the mast (6) about a pivot axis (146). The pivot axis (146) carries a direction changing roll (148) with which are associated assisting rolls (150,152). The first assisting roll (150) is arranged on the mast (6) and bends the tension member (122) toward the underside of the direction changing roll (148) so that this is engaged from the bottom by the tension member, with the second assisting roll (152) being arranged on the connecting strut (142) and bending the tension member from the underside of the direction changing roll (148) into the interior of the connecting strut. With this arrangement, the angle of engagement of the tension member (122) with the direction changing roll (148) becomes larger as the carrier beam (10) is extended outwardly so that length changes of the tension member, which occur due to diminished engagement angles of the tension member with the other direction changing rolls are compensated. Upon inward movement of the carrier beam, the engagement of the tension member (122) with the direction changing roll (148) is diminished and thereby frees some length of the tension member which is needed because of the increased engagement of the tension member with the other direction changing rolls on the carrier beam. In the instant case, the diameter of the direction changing roll (148) is so chosen that the engagement length change is equally as large as the change of the engagement length on the direction changing roll (32) of the joint (34) by which the connecting strut (142) is connected to the carrier beam (10).

Figure 10:
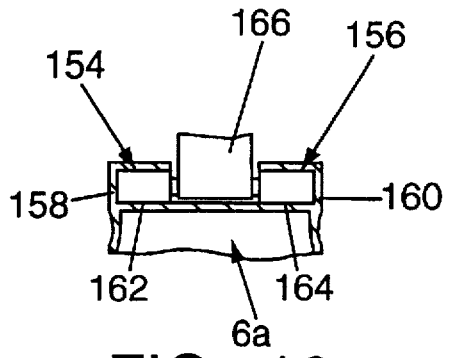
FIG. 10 - An alternative hollow profile for the mast of the standing umbrella of the invention.
Figure 11:
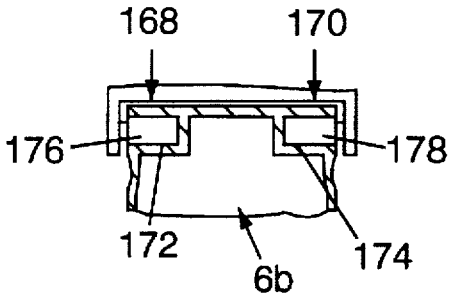
FIG. 11 - Another alternative hollow profile for the mast of the standing umbrella of the invention.
Figure 12:
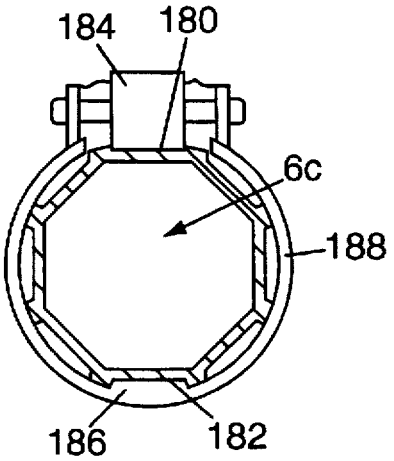
FIG. 12 - A still further alternative hollow profile for the mast of the standing umbrella of the invention.

FIGS. 10–12 show alternative forms of the hollow cross section of the mast (6). In FIG. 10, two guide tracks (154,156) of the mast (6*a*) are formed by two oppositely directed C-shaped profile portions, which have oppositely directed grooves (162,164) for receiving a guide element (166) of a carrier beam. In FIG. 11, the mast (6*b*) has two outwardly lying guide tracks (168,170) which form guide grooves (172,174) pointing in opposite directions from one another, and in which grooves guide elements (176,178) of the inner end of the carrier beam extend from outside. The mast (6*c*) of FIG. 12 is octagonally formed and has on diametrically opposite sides channel shaped guide tracks (180,182) in which are received guide elements (184,186) which are connected with one another by a cuff shaped ring (188) surrounding the mast (6*c*).

There are still other numerous exemplary embodiments which are possible, and especially the elements of the foregoing exemplary embodiments are exchangeable with one another and are capable of being further developed.

I claim:

1. A standing umbrella comprising:

a stand (2) having a mast (6,6*a*,6*b*,6*c*) with an upper end (16), a carrier beam (10) having an inner end (8) and an outer end (12), with said inner end (8) of said carrier beam being guided on said mast for outward and inward movement of said carrier beam relative to said mast, an umbrella stick (38) of a collapsible umbrella (14) carried on said outer end (12) of said carrier beam, a connecting strut (18,142) linkedly connected between said upper end (16) of the mast (6,6*a*,6*b*,6*c*) and said carrier beam (10), a drive mechanism (20,20*a*,24,24*a*) shifting said carrier beam (10) relative to said mast in a shifting direction as well as opening and closing said umbrella (14), said mast (6,6*a*,6*b*,6*c*) having two guide tracks (64,66, 154,156,168,170,180,182) spaced from one another, and guide elements (22,166,176,178,184,186) on said inner end of said carrier beam in cooperation with said two guide tracks, said guide tracks being so profiled that said guide elements (22,166,176,178,184,186) are held by the shape of said tracks transversely to said shifting direction.

2. A standing umbrella according to claim 1, wherein:

said mast (6,6*a*,6*b*,6*c*) has a closed hollow cross section.

3. A standing umbrella according to claim 2, wherein:

said guide elements (22,68*a*,68*b*,70*a*,70*b*,166,176,178, 184,186) are supported on a guide carriage (72) which guide carriage is linkedly connected with said inner end (8) of said carrier beam (10).

4. A standing umbrella according to claim 2, wherein:

said carrier beam drive mechanism (20,20*a*) includes a circulating member (84,110) located inside the mast (6) and drivable through a drive (92,100,102) by means of a hand crank (106,120) or a motor (104), which circulating member at the ends of the shifting path of the guide elements (22,68*a*,68*b*,70*a*,70*b*,166,176) is bent over direction changing members (88,92,112,118), and through openings (90,94,114) in the mast located on the outer side of the mast (6) in the area of the guide tracks (64,66,154,156,168,170).

5. A standing umbrella according to claim 1, wherein:

said guide tracks (64,66,154,156,168,170) have guide grooves (64*a*,64*b*,66*a*,66*b*,162,164,172,174) lying in a guide plane parallel to said mast and extending perpendicular to said shifting direction, said guide grooves in the direction transversely to said guide tracks being located opposite to one another.

6. A standing umbrella according to claim 1, wherein:

said mast (6,6*a*,6*b*) has a rectangular profile, on one side of which profile said guide tracks (64,66,154,156) are formed.

7. A standing umbrella according to claim 1, wherein:

said mast has a lower end portion defining an anchoring region of the mast for holding the mast in place when in use, and said mast (6,6a,6b,6c) is arranged to incline rearwardly when in use, so that the center of gravity of the closed umbrella lies above the anchoring region of the mast.

8. A standing umbrella according to claim 1, wherein:

said drive mechanism (20,20a) includes a first drive mechanism to shift the inner end (8) of the carrier beam and a second drive mechanism to open and close the umbrella (14), said first and second drive mechanisms being combined with one another so that they are simultaneously operable in common.

9. A standing umbrella according to claim 8, wherein:

said carrier beam drive mechanism (20,20a) has a circulating member (84,110) drivable through a drive (92, 100,102), said circulating member is connected with the inner end (8) of the carrier beam (10) and at the ends of the shifting path of the carrier beam (10) is guided over direction changing members (88,92,112,118).

10. A standing umbrella according to claim 9, wherein:

said carrier beam drive mechanism (20) has a spindle (100) provided with a self-arresting thread on which spindle is arranged a threaded nut (98) connected with the circulating member (84).

11. A standing umbrella according to claim 8, wherein:

said umbrella drive mechanism (24,24a) for opening and closing the umbrella (14) includes a tension member (26,122) guided over the upper end (16) of the mast (6), and further over said connecting strut (18,142) and a joint (34) into the carrier beam (10) to extend to the outer end (12) of the carrier beam (10) and through the umbrella stick (38) to be connected to a terminating member (40,42) secured to the lower ends of support struts (44), said support struts (44) being linkedly connected to roof rods (46) which in turn are linkedly connected with a crown (48) attached to the top portion of the umbrella stick (38).

12. A standing umbrella according to claim 11, wherein:

said tension member (26,122) is coupled with the circulating member (84,110).

13. A standing umbrella according to claim 12, wherein:

said tension member (122) is guided over a compensating mechanism (140) to compensate for tension changes in the tension member (122) resulting from changes in the lengths at different angular positions of the carrier beam (10).

14. A standing umbrella according to claim 13, wherein:

said compensating mechanism (140) includes a direction changing roll (148) mounted on the upper end of the mast in the area of the joint connecting the connecting strut to the upper end of the mast, associated with said direction changing roll (148) is a first assisting roll (150) on the mast and a second assisting roll (152) on the connecting strut (142) so arranged that the tension member (122) passes over the first assisting roll (150), then goes under the direction changing roll (148) and then over the second assisting roll (152) to the connecting strut (142).

15. A standing umbrella according to claim 11, wherein:

said tension member (122) includes a mechanism (126) operable during opening of the umbrella (14) releasably arresting the tension member (122) and uncoupling it from the circulating member (110).

16. A standing umbrella according to claim 15, wherein:

said tension member (122) is connected with the circulating member (110) by a stop (128) which couples only in the opening direction and has an arresting member at its end facing away from the umbrella (14), said arresting member cooperates with an inwardly movable bolt (133) on the mast (6).

17. A standing umbrella according to claim 8, wherein:

said carrier beam has a longitudinal axis (54), and said umbrella stick has a pivot axis (52) displaced downwardly from said carrier beam longitudinal axis (54), said pivot axis (52) is pivotally connected to the umbrella (14) above the crown (48), the umbrella stick (38) extending upwardly to the region of the longitudinal axis (54) of the carrier beam (10) and carrying a direction changing roll (56) for the tension member (26).

* * * * *